US006926210B2

(12) United States Patent
Baxter

(10) Patent No.: US 6,926,210 B2
(45) Date of Patent: Aug. 9, 2005

(54) SYSTEM FOR MAINTAINING GUTTER DEBRIS FREE

(76) Inventor: David Baxter, 921 First St., Altamonte Spring, FL (US) 32701

( * ) Notice: Subject to any disclaimer, the term of this patent is extended or adjusted under 35 U.S.C. 154(b) by 6 days.

(21) Appl. No.: 10/649,302

(22) Filed: Aug. 27, 2003

(65) Prior Publication Data

US 2005/0045738 A1 Mar. 3, 2005

(51) Int. Cl.[7] ..... B05B 3/00; B05B 17/04; A01G 27/00

(52) U.S. Cl. ..... 239/208; 239/67; 239/68; 239/69; 239/70; 239/373; 239/63

(58) Field of Search ..... 239/208, 63, 67, 239/68, 69, 7, 373, 722; 169/9, 13, 16, 45; 134/104.4, 166 R; 52/12, 16

(56) References Cited

U.S. PATENT DOCUMENTS 4,183,368 A 1/1980 Husted
4,349,039 A 9/1982 Egger
4,363,335 A 12/1982 Tapper
4,634,312 A 1/1987 Sterzel
4,972,863 A 11/1990 Marrow
5,165,482 A * 11/1992 Smagac et al. ..... 169/45
5,390,853 A 2/1995 Ellul
5,406,966 A * 4/1995 Lepkowski et al. ..... 134/104.4
5,725,322 A 3/1998 Evans
5,727,350 A * 3/1998 Marcella ..... 52/12
6,257,264 B1 * 7/2001 Sturman et al. ..... 137/1
6,446,302 B1 * 9/2002 Kasper et al. ..... 15/319
6,766,560 B2 * 7/2004 Murphy ..... 15/414

* cited by examiner

*Primary Examiner*—David A. Scherbel
*Assistant Examiner*—Seth Barney

(57) ABSTRACT

An automatic gutter cleaning system for cleaning a rain valley, gutter or drainage channel with a medium, such as air or water. The system includes carrying apparatus for carrying the medium through nozzles into the gutter or channel. The medium flushes the debris located in the valley or gutter either out of the valley or gutter or down the gutter through the down spouts. The system is automatically operated by a controller that either controls the frequency the medium is sent to the nozzles or turns on the system due to inputs from a monitoring means that monitors whether debris is or isn't present in the valley or gutter.

5 Claims, 3 Drawing Sheets

SYSTEM FOR MAINTAINING GUTTER DEBRIS FREE

FIELD OF INVENTION

The present invention relates to a system and method of cleaning a rain valley and/or gutter located on residential or commercial structures. More specifically the present invention is an automatic system that uses water or air, forced down the valley and into the gutter, to maintain it clear of any debris that falls therein. Accordingly, the general objects of the present invention are to provide novel and improved system of maintaining rain or storm gutters continuously free from debris that falls into the gutter thus insuring their proper operation.

BACKGROUND OF THE INVENTION

There have been many gutter cleaning devices developed in the past. Various hand held devices have been used to manually clean a gutter from debris such as leaves, twigs or other items that fall into the gutter from the roof of a building, such as a home or commercial building. What is well known is various manual rakes and other similar type devices. These required climbing a ladder, sliding the rake down the gutter and working with the rake to clear the gutter from debris. The use of the rake is dangerous for a person on the ladder since he is likely to fall from the ladder due to the maneuvering he has to perform to clear the gutter of debris.

Another manually used device to clean a gutter from debris is a hand held wand. The wand has an elongated pole with a J curve at the top of the pole for forcing water down into the gutter. The wand is attached to a garden hose to supply water flush the gutter. In order to use this wand one must manually run it along the gutter to clear it from the debris located therein. There have been many variations of this hand held wand. The designs mainly vary in the J curve and spray nozzle. The disadvantage of these wand designs is that it has to be used manually and when it is used the debris will fall upon the person using the wand. It is also difficult and tiresome for a home owner or commercial service provider to stand and run the wand along the gutter to clear it from debris.

There has also been various spray systems used in the past to clear gutters. These systems generally comprised of piping or tubes that have orifices therein or nozzles attached thereto. Water is sprayed into the gutter to flush debris from the gutter. The disadvantage of these system is that they were manually operated and not automatic such that one would flush the accumulated debris from the gutter towards the downspout just as in rain would do. This would cause the debris to clog either the opening of the downspout at the junction of the gutter and downspout or the downspout itself. This was due again to an operator turning the system on whenever he thought it was needed and not at regular intervals. The accumulated debris was significant due to the long time intervals between the system being turned on manually.

Other devices have also been used in an effort to keep the debris from clogging the down spout of a gutter. These devices include screens, having various shapes and sizes placed at the junction of the gutter and the down spout. These only provide a temporary solution to prevent the debris from clogging the opening of the downspout or the down spout itself. These screens also have to be cleaned from time to time manually or else the debris will accumulate against the screen resulting in clogging of the down spout and prevent the rain water in the gutter from flowing into the down spout from the gutter. Again to keep the screen clear one would have to climb a ladder or get on the roof, which as stated above is dangerous.

All the above past devices fall short of providing a convenient system that automatically maintains the gutters of a residence or commercial building or any drainage channel clear of debris so as not to prevent water from flowing down and out of the gutter or channel.

SUMMARY OF THE INVENTION

The present invention overcomes all of the deficiencies of the prior art gutter cleaning device. It is an object of the present invention to provide an automatic gutter cleaning system that flushes debris on regular intervals to insure that the debris does not accumulate and clog the gutter or downspout.

It is another object of the invention to provide a low cost efficient gutter cleaning system that can be easily installed and operated. Other objects and advantages of using the present invention will be apparent from the accompanying drawings and the description of the invention.

The present invention provides an automatic system and method that can easily be used manually or automatically to maintain gutter substantially clear from debris that falls into the gutter of a residence or a commercial building. A system is described for removing debris from a gutter of a residential or commercial building or other structure having at least one nozzle, for directing a medium there through, being located along the gutter, a carrying apparatus, such as a pipe, is provided to carry a medium such as air or water to the nozzles. The medium is under pressure in the carrying apparatus. This pressure can be provided for water by using the water supply of the residence or commercial building or can be provided independently. A controller is used to automatically turn on the system and allow water or air to flow through the pipe and the nozzles into the gutter. The water or air is forced through the nozzles into the gutter. If water is used then the debris, such a leaves or twigs, are flushed along the gutter down the down spout. If air is used, then the pressurized air blows into the gutter and blows the debris out of the gutter. Air is used to force difficult debris, such as pine needles and the like, out over the top of the gutter. If either water or air is used with the present invention, then the gutter is freed from any debris that may cause clogging or blocking of the valley, gutter or drain.

The control system can be programmed to control the frequency at which the water or air is blown out of the nozzles to insure that the amount of build-up of debris is minimized but yet the frequency is minimized in order not to waste water or air pressure used in the system. The control system may also have a monitoring device or sensor that is used to determine if debris is located in the gutter and if so, automatically turn on the system to flush the valley, gutter or drain of debris.

DETAILED DESCRIPTION OF THE PRESENT INVENTION

Figure 1:
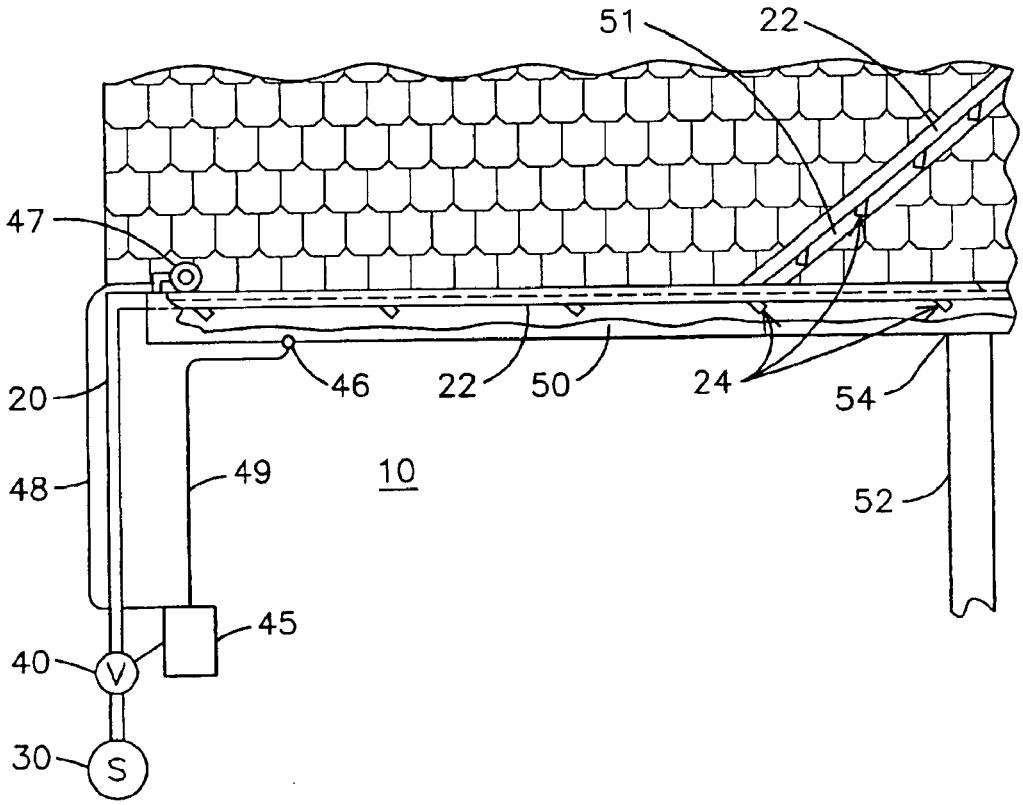
FIG. 1 is a schematic view of the system of the present invention.

Accordingly, an embodiment of the present invention that overcomes the deficiencies of the prior gutter cleaning devices is hereafter described. Referring to FIG. 1, there is shown one embodiment of the automatic gutter cleaning system 10 of the present invention. The system 10 has a carrying apparatus such as a pipe or tube 20. This pipe or tube can be flexible or stiff and made of any type of material, such as rubber, PVC, UPVC or metal, such as cooper. The pipe 20 is attached to the gutter 50, shown in phantom for illustrative purposes only, or valley 51, by a variety of means which will be described in more detail below.

Also part of the carrying apparatus is a second pipe or tube 22 the carries the medium, such as water or air, that is used to clear the gutter 50 or valley 51 of debris. As stated above this pipe 22 can be flexible or stiff and made from a variety of materials that are available on the market. Nozzles 24 are attached to the pipe 22 at various locations along the pipe 22. The location of the nozzles 24 along the pipe depends upon several variables. These variables include; the pressure and volume that the medium will be provided, the medium density, whether it's water or air or both, the size of the orifices of the nozzles, the size of the gutters, the length of the valley and/or gutters, the volume of medium that will be forced through the nozzles in one section or entire system, and the type and number of trees or plants and branches that hang over the gutter and roof of the building. One skilled in the art would determine the distance between each of the nozzles depending upon the size of the gutters for a specific residential or commercial building or drainage channel along with determining each of the above mentioned variables. Thus, on average, the system will be similar for most homes but will be customized for each home depending upon these variables.

The pipe 20 is attached to the medium supply 30 through valve 40. This medium supply can either be pressurized air between 20 and 500 psi or water that is from the tap or other water supply such as a separate pump, or a swimming pool pump. It should be understood that the supply may be provided by the local utility company or may be independently supplied by a separate system. If water is used in the system then it is preferable at a pressure between 20 psi and 3500 psi. Also, the supply could be a leaf blower utilized by a lawn service or homeowner that is temporarily attached to the pipe to force air through the system. If a leaf blower is used as the supply 30 then the below described valve and controller is not required. The leaf blower may be controlled by the controller if it continuously attached to the pipe 20.

The valve 40 is controlled either manually, semi-automatically or automatically by controller 45. The controller 45 can be any of a variety of electronic or mechanical controllers that are available on the market for controlling valves 40. For example, that controller 45 may either be set to operate at certain frequencies based upon time intervals or may be based upon input from a monitoring device such as a sensor 46 or camera 47. The camera 47 can be set at a fixed position and viewed by owner of the building to check and see if the system 10 needs to be operated or may determine if the frequency needs to be changed to run the system 10. The camera 47 may also be used to dynamically monitor the valley 51 or gutter 50 so as to send a signal to the controller 47 through wired 48 that debris has accumulated in the valley 51 or gutter 50 and the system 10 needs to be run. The camera may also pivot by a motorized means so as to be used as a security camera for monitoring the owners property.

If a sensor 46 is used to sense that debris has fallen into the gutter 50 then when the sensor 46 determines that a certain amount of debris is located in the valley 51 or gutter 50 it will send a signal through wire 49 to the controller 45 to operate the system by opening the valve 40. The use of the sensor 46 make the system automatic without user interface. It should be understood that once the system is turned on, the controller 45 controls based upon its programming how the system will operate. For example, the system will either operate based upon timed intervals or by the sensing of whether or not debris is located in the gutter or whether debris is currently being cleared or is cleared from the gutter 50. The controller may be part of a home computer system or a house computer that operates various devices throughout the home.

Once the system 10 is operating the medium from the supply 30 flows through the valve 40 being opened by the controller, through pipe 20 and 22 out the nozzles 24. The medium, if water, then sprays out of the nozzles into the gutter flushing the debris down the valley 51 and gutter 50 into the down spout 52 via junction 54. If the medium is air then the air is forced out the nozzles at a high velocity, thus blowing the debris out of the gutter 50.

The determination as to what type of medium is used is based upon several factors. For example, it may be more beneficial to use air as the medium if pine needles or large leaves is the common debris in the gutter since pine needles or large leaves do not flow into the down spout, 52 but clog the junction 54 due to their length and shape. Water is more beneficial for smaller leaves since they will flow past junction 54 and since air may not blow the smaller leaves out but only churn them in the gutter 50. The installer of the system 10 will determine the most optimum system to use as stated above based upon the amount of debris that falls into the gutter due to the trees that overhang on the roof of the building.

Figure 2:
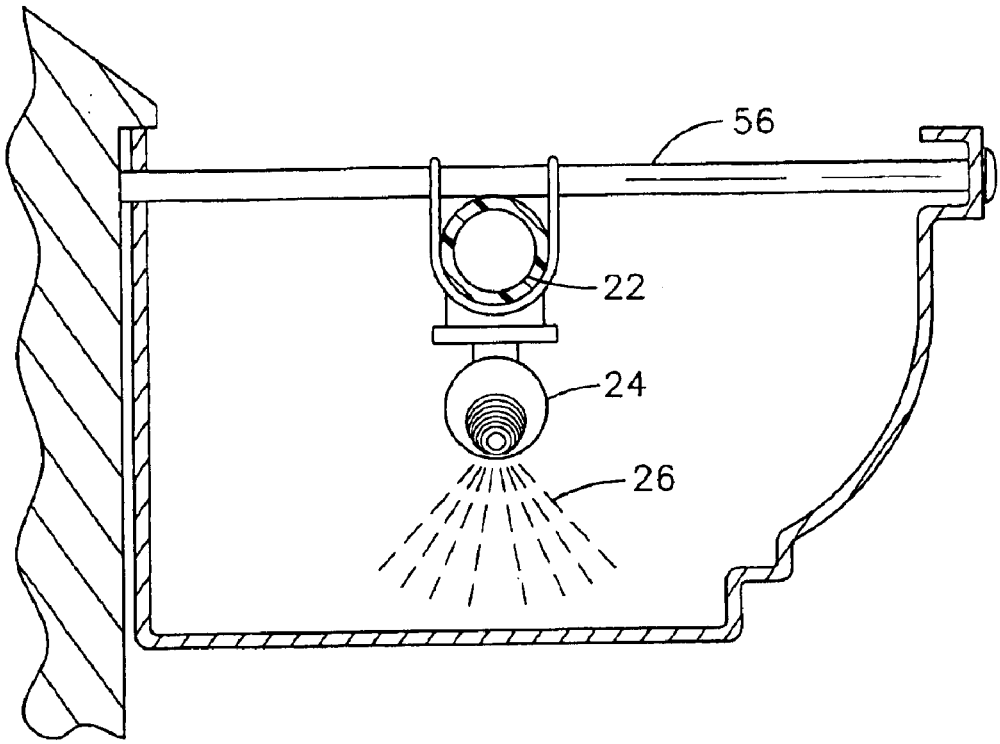
FIG. 2 is a cross section of a gutter with the device of the present invention installed therein.
Figure 3:
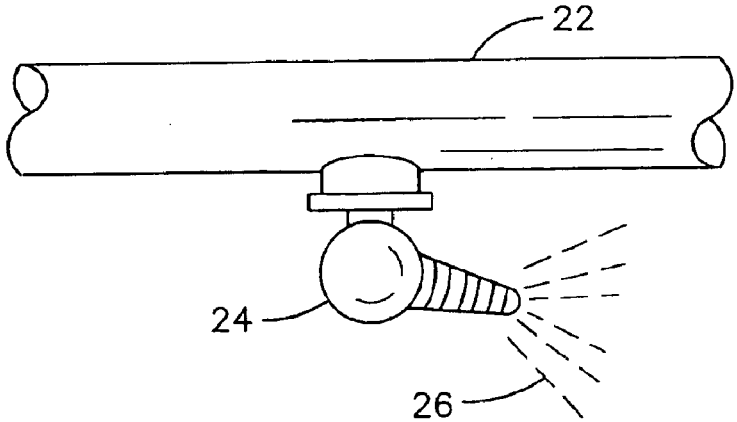
FIG. 3 is a view of a nozzle that is used in the system of the present invention.

Referring to FIGS. 2 and 3, there is shown one embodiment of the nozzles 24 to be used in the system 10 of the present invention. It is preferred that the nozzles be adjustable so as to allow easy installation of the system 10. By allowing the nozzles to be adjustable the installer can optimize the angle with respect to the longitudinal axis of the gutter 50 the medium 26 will be force out of the nozzle 24. It should be understood the nozzle 24 may also be in a fixed position and not adjustable. Is should also be understood that orifices in the tube or piping may be used instead of nozzles.

The nozzles 24 is attached to the pipe by standard means known to one skilled in the art. The pipe 22 is attached to the cross member 56 of the gutter 54 by a strap, snap member or U bolt or clamp or other attachment device commonly known to one skilled in the art. If used in a valley 51 then the pipe is attached to the roof by means know to one skilled in the art.

Figure 4:
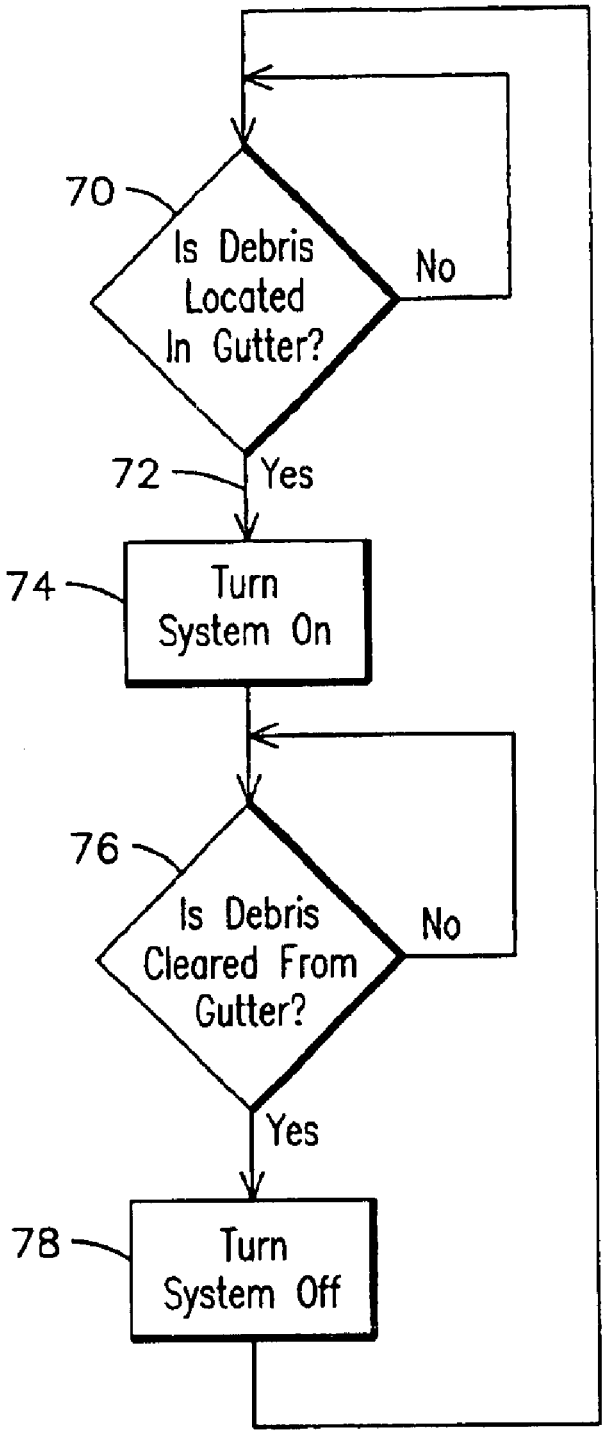
FIG. 4 is a flow diagram of the method of controlling the system of the present invention.

Referring now to FIG. 4 the operation of the controller of the system 10 of the present invention are shown. The sensor 46, camera, 47 or operator determines where the debris is located in the gutter 70. If it is determined that debris is located in the gutter 50 then the sensor 46, camera 47, or operator will send a signal to the controller 45 that the system 10 must be run to clear the debris from a valley and/or gutter 50. The controller will then send a signal to the valve 40 to open 74 allowing medium 26 to flow through the pipe 20, 22 and nozzles 24 into the valley and/or gutter flushing or blowing the debris from the gutter 50. Once the time interval has expired, as set or programmed into the controller 45, or it is determined by the sensor 46 or camera

47, or operator, that substantially all of the debris has been removed from the gutter 76 then the system is turned off 78 by the controller by sending a signal to the valve 40 to close.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A system for removing debris from a valley/gutter of a residential or commercial building or other structure comprising:

a plurality of orifices for directing a clearing medium there through being attached and positioned located along the valley/gutter in order to direct the medium into the valley/gutter;

a pipe for transporting the medium being pressurized into the orifices;

a system to pressurize and force the medium through the pipe and to the orifices;

a automatic controller for controlling when and how long in time the medium is forced through the pipe into the valley/gutter flushing any debris located in the valley/gutter down the valley/gutter into a down spout attached to the gutter thereby having the valley/gutter substantially free from debris mud allowing any rain caught therein to flow freely through the valley/gutter and the down spout; and a monitoring apparatus connected to the automatic controller for monitoring the gutter to determine if a certain amount of debris has entered the valley/gutter and triggering the automatic controller, once such certain amount is reached, and monitoring the gutter once such certain amount of debris is removed from the valley/gutter and triggering the automatic controller to shut off the system due to such certain amount of debris is removed.

2. The system in accordance with claim 1 wherein the medium is air which is pressurized by an air compressor having a pressure of 20 psi and 500 psi.

3. The system according to claim 2 wherein the valley/gutter defines an axis and the orifices being position at and angle from the axis into the valley/gutter in order to spray the air substantially parallel to the axis in order to flush the debris located along the valley/gutter out of the valley/gutter.

4. The system of according to claim 2 wherein the orifices have openings with a diameter and shape to provide a sufficient spray and force of the air into the valley/gutter to clear the debris located in the valley/gutter.

5. The system in accordance with claim 1 wherein the monitoring apparatus is a camera that dynamically monitors the valley/gutter to sense that such certain amount of debris has entered the gutter.

* * * * *